US010622731B2

(12) United States Patent
Wu et al.

(10) Patent No.: US 10,622,731 B2
(45) Date of Patent: Apr. 14, 2020

(54) MINIATURIZED CABLE CONNECTOR ASSEMBLY

(71) Applicant: FOXCONN INTERCONNECT TECHNOLOGY LIMITED, Grand Cayman (KY)

(72) Inventors: Jerry Wu, New Taipei, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/015,561

(22) Filed: Jun. 22, 2018

(65) Prior Publication Data

US 2018/0375232 A1 Dec. 27, 2018

(30) Foreign Application Priority Data

Jun. 22, 2017 (CN) ..... 2017 1 0481305

(51) Int. Cl.

| | |
|---|---|
| ***H01R 9/03*** | (2006.01) |
| ***H01R 13/627*** | (2006.01) |
| ***H01R 13/58*** | (2006.01) |
| ***H01R 13/6593*** | (2011.01) |
| ***H01R 4/18*** | (2006.01) |
| ***H01R 4/20*** | (2006.01) |
| ***H01R 13/502*** | (2006.01) |

(Continued)

(52) U.S. Cl.

CPC ..... *H01R 9/03* (2013.01); *H01R 4/182* (2013.01); *H01R 4/20* (2013.01); *H01R 9/034* (2013.01); *H01R 13/502* (2013.01); *H01R 13/5808* (2013.01); *H01R 13/6273* (2013.01); *H01R 13/6275* (2013.01); *H01R 13/6593* (2013.01); *H01R 13/562* (2013.01); *H01R 13/6597* (2013.01)

(58) Field of Classification Search

CPC ..... H01R 13/6581; H01R 13/6582; H01R 13/6585; H01R 24/60; H01R 13/5845

USPC ..... 439/353, 607.41, 607.48, 470

See application file for complete search history.

(56) References Cited

U.S. PATENT DOCUMENTS 7,909,632 B2 * 3/2011 Wu ..... H01R 9/03 439/353

8,062,050 B2 * 11/2011 Wu ..... H01R 13/6582 439/350

(Continued)

FOREIGN PATENT DOCUMENTS

CN 107809016 3/2018

*Primary Examiner* — Hae Moon Hyeon

(74) *Attorney, Agent, or Firm* — Wei Te Chung; Ming Chieh Chang

(57) ABSTRACT

A cable connector assembly includes: a plug including an insulative housing, plural conductive terminals received in the insulative housing, and a latch, the conductive terminals including a row of first terminals and a row of second terminals, the latch being disposed between the row of first terminals and the row of second terminals; a cable directly electrically connected to the conductive terminals of the plug; a crimping member; and a metal shell set on the outside of the plug, wherein the crimping member includes a crimping ring crimped on the outside of the cable, a reinforcement fixed to a tail of the plug, and a connecting portion connecting the crimping ring and the reinforcement.

11 Claims, 9 Drawing Sheets

(51) Int. Cl.
*H01R 13/6597* (2011.01)
*H01R 13/56* (2006.01)

(56) References Cited

U.S. PATENT DOCUMENTS

| | | | | |
|---|---|---|---|---|
| 9,768,568 | B1 * | 9/2017 | Jin | H01R 24/60 |
| 10,084,245 | B2 * | 9/2018 | Chang | H01R 13/6586 |
| 2016/0079689 | A1 | 3/2016 | Wu et al. | |
| 2016/0079714 | A1 * | 3/2016 | Wu | H01R 13/6585 439/607.05 |
| 2016/0141797 | A1 * | 5/2016 | Wu | H01R 13/6593 439/607.55 |
| 2018/0062324 | A1 * | 3/2018 | Wu | H01R 13/6616 |
| 2018/0166797 | A1 * | 6/2018 | Ju | H01R 13/6597 |
| 2018/0166825 | A1 * | 6/2018 | Ju | H01R 13/6275 |
| 2018/0212338 | A1 * | 7/2018 | Chang | H01R 13/6586 |
| 2018/0212366 | A1 * | 7/2018 | Chang | H01R 13/6593 |

* cited by examiner

MINIATURIZED CABLE CONNECTOR ASSEMBLY

BACKGROUND OF THE INVENTION

1. Field of the Invention

The present disclosure relates to a miniaturized cable connector assembly.

2. Description of Related Arts

US Patent application publication No. 20160079689, published Mar. 17, 2016, discloses a cable connector assembly. The cable connector assembly includes a plug, a PCB (Printed Circuit Board) connected with the plug, a cable connected with the PCB, a first metal shell receiving PCB and part of plug, a second metal shell receiving part of the first metal shell and cable, and a cage disposed outside the first metal shell and the second metal shell. The cable connector assembly has a large number of parts and a complex structure, so that the overall structure of the cable connector is large, and it is difficult to meet the current demand for miniaturization.

An improved miniaturized cable connector assembly to improve product yield is desired.

SUMMARY OF THE INVENTION

Accordingly, an object of the present invention is to provide a cable connector assembly with simple and stable structure.

To achieve the above object, a cable connector assembly comprises: a plug including an insulative housing, a plurality of conductive terminals received in the insulative housing and a latch, the conductive terminals including a row of first terminals and a row of second terminals, the latch being disposed between the row of first terminals and the row of second terminals; a cable directly electrically connected to the conductive terminals of the plug; a crimping member; and a metal shell set on the outside of the plug, wherein the crimping member includes a crimping ring crimped on the outside of the cable, a reinforcement fixed to a tail of the plug, and a connecting portion connecting the crimping ring and the reinforcement.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
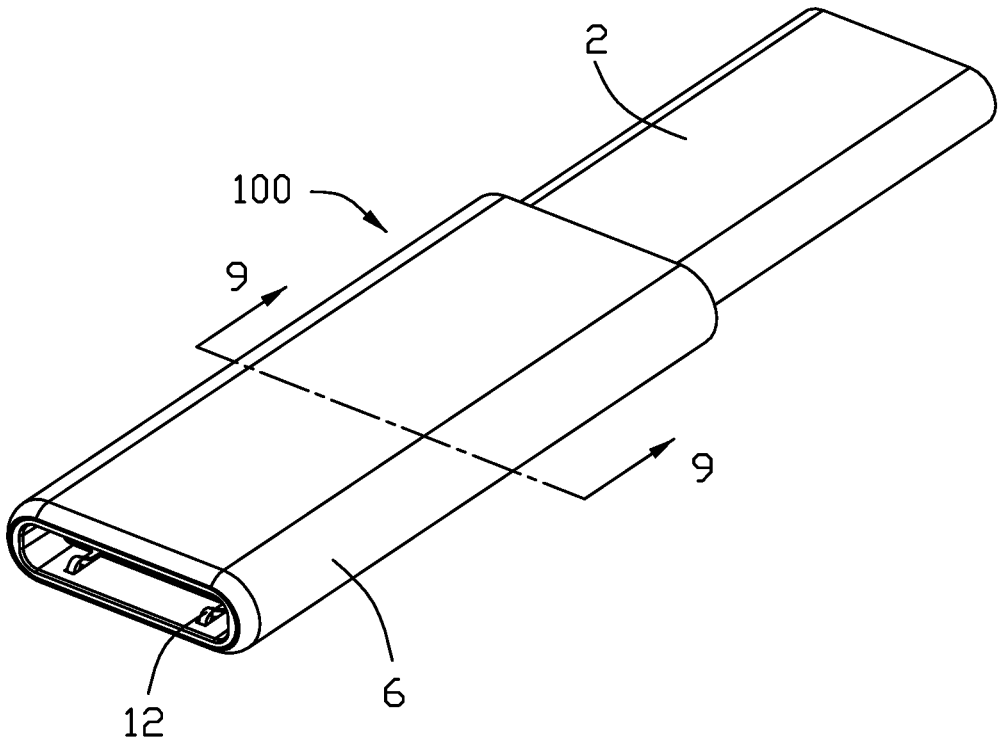
FIG. 1 is an perspective view of a cable connector assembly in the present invention.
Figure 2:
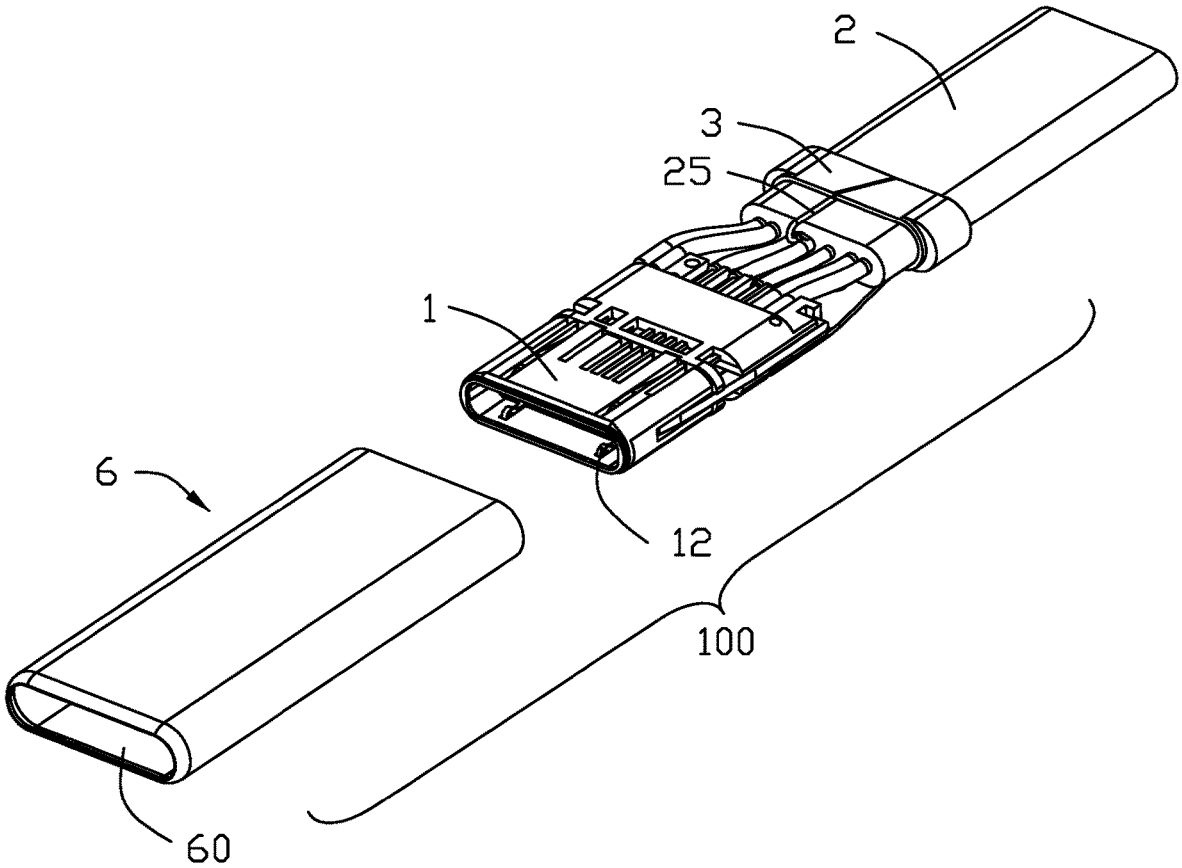
FIG. 2 is a partially exploded view of the cable connector assembly as shown in FIG. 1.
Figure 3:
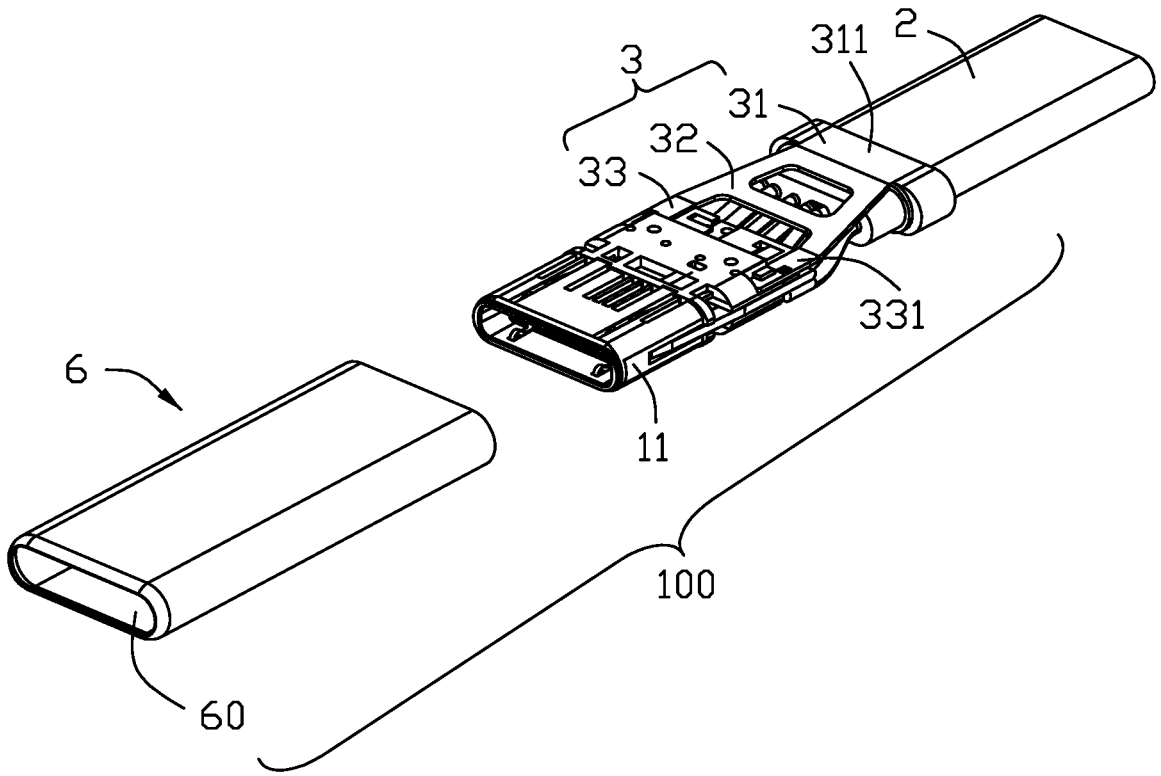
FIG. 3 is another exploded view of the cable connector assembly as shown in FIG. 2.
Figure 4:
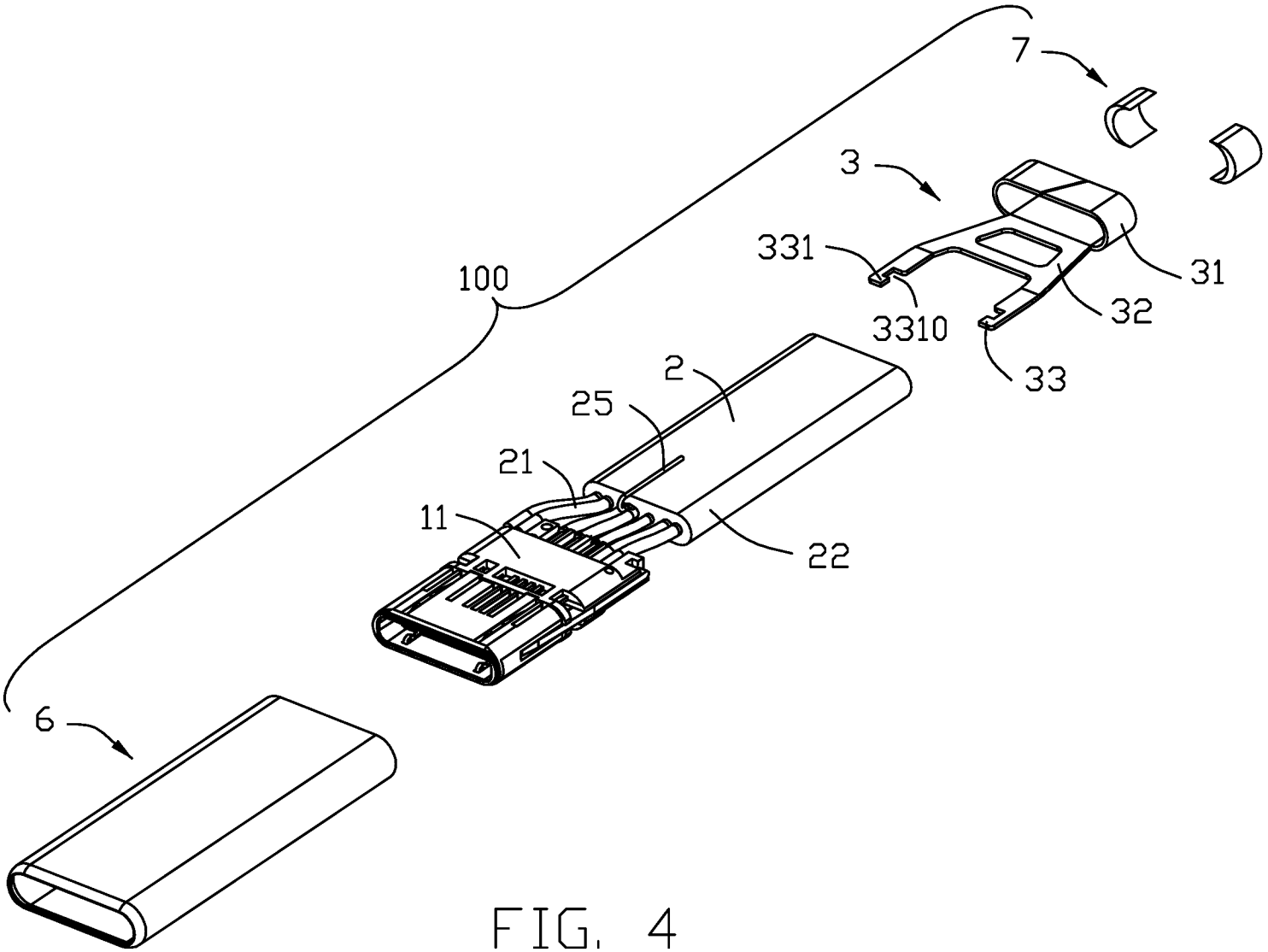
FIG. 4 is further exploded view of the cable connector assembly as shown in FIG. 2.
Figure 5:
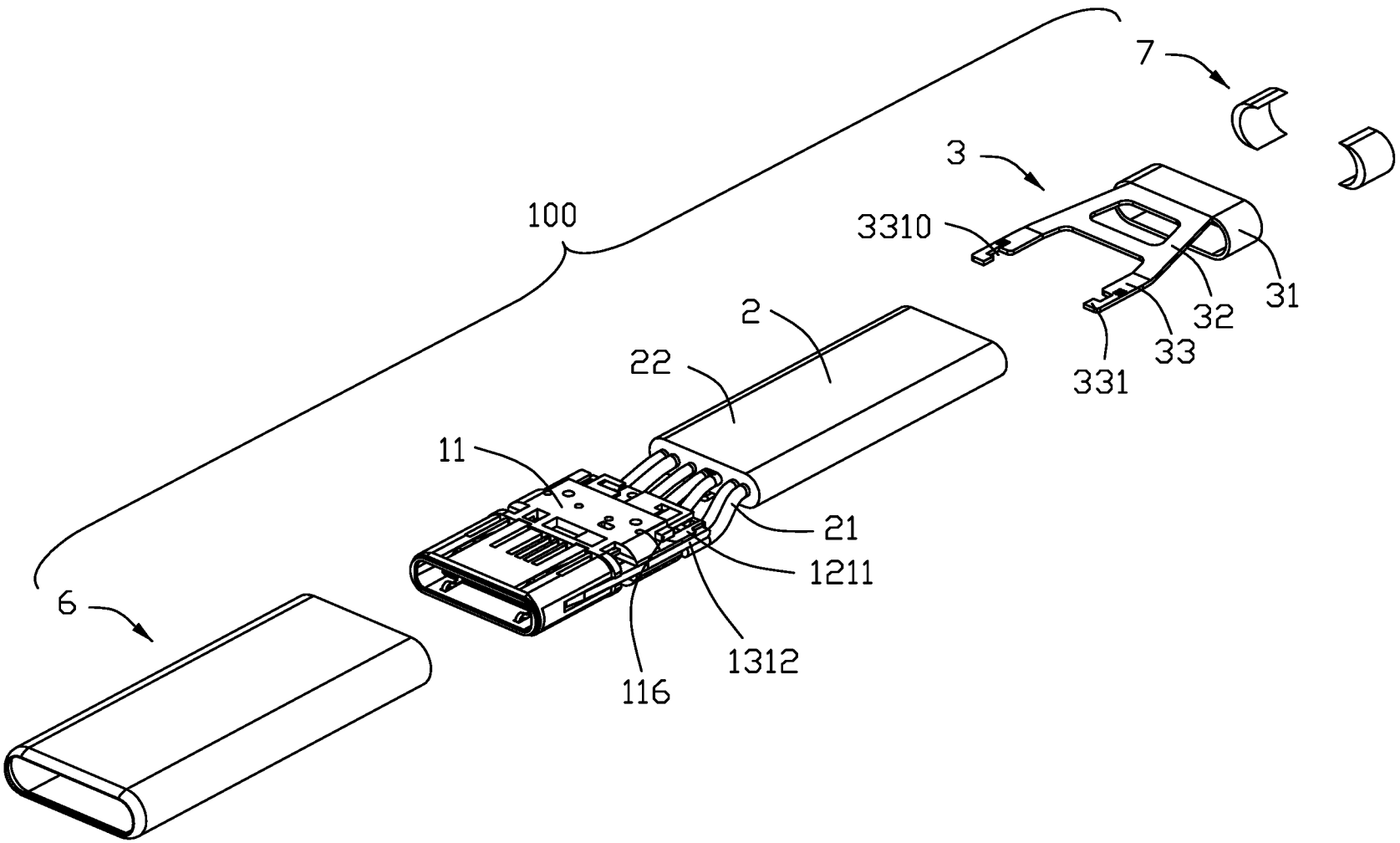
FIG. 5 is another exploded view of the cable connector assembly as shown in FIG. 4.
Figure 6:
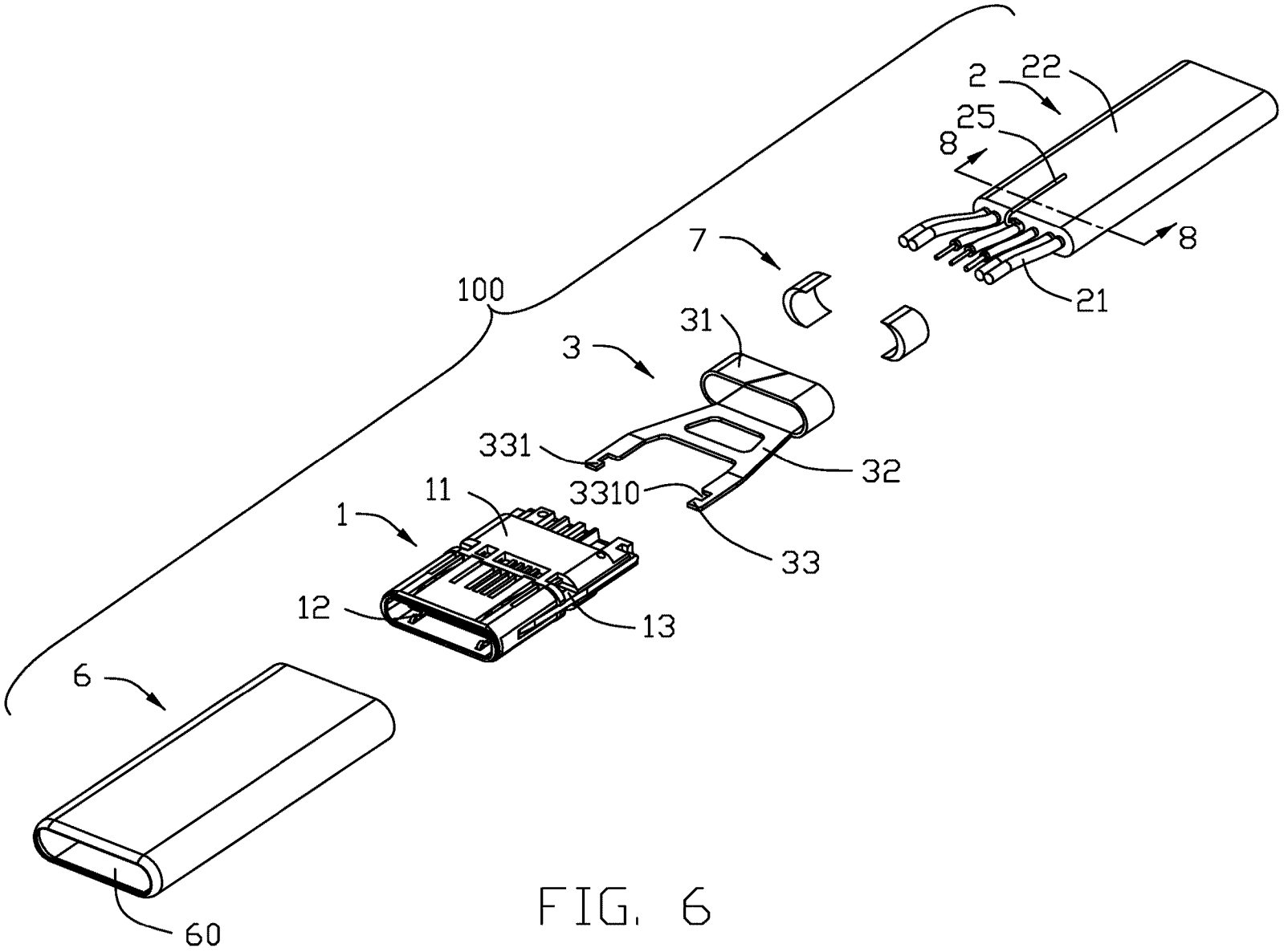
FIG. 6 is further exploded view of the cable connector assembly as shown in FIG. 4.
Figure 7:
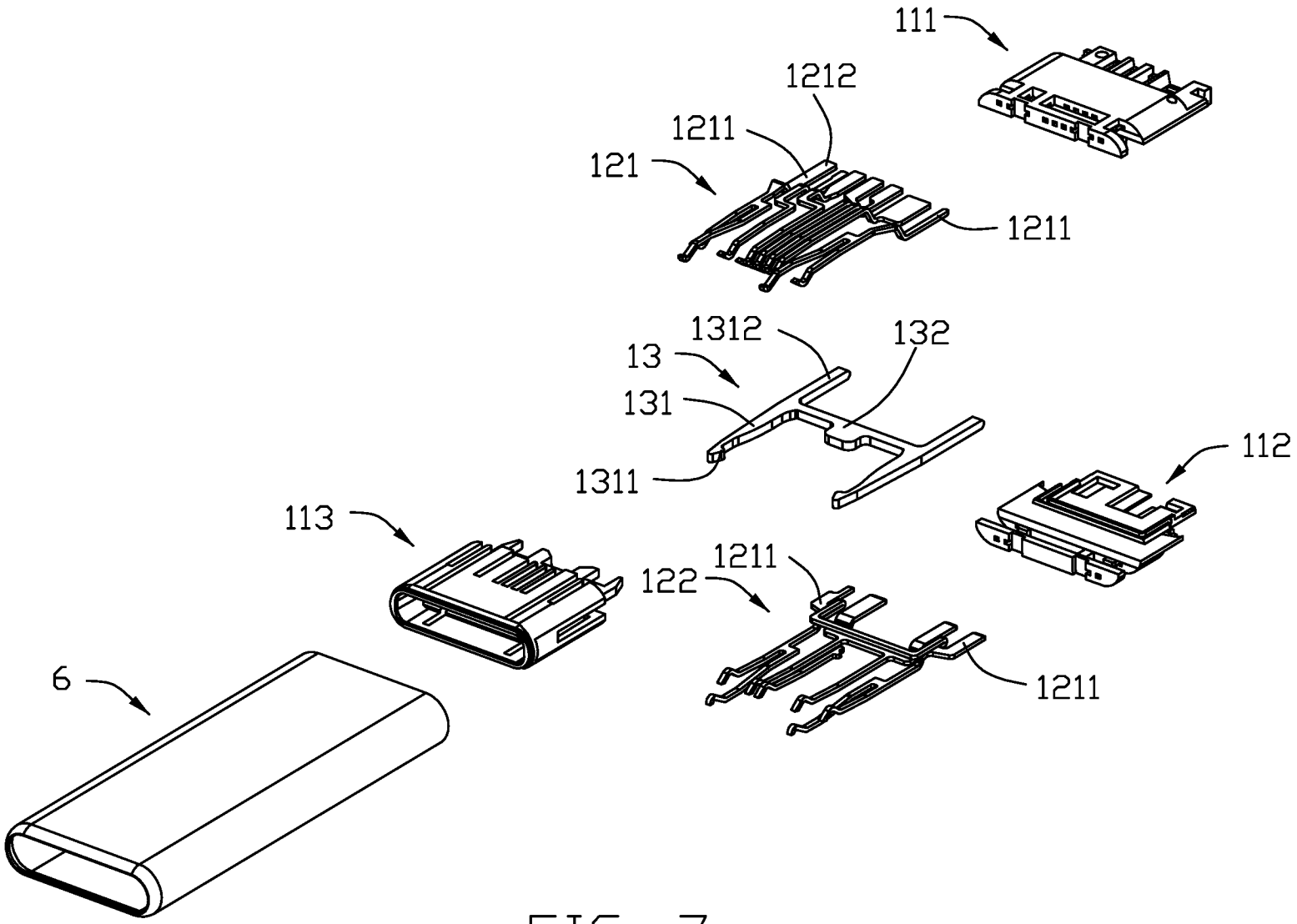
FIG. 7 is a exploded view of a plug and a metal shell of the cable connector assembly in the present invention.
Figure 8:
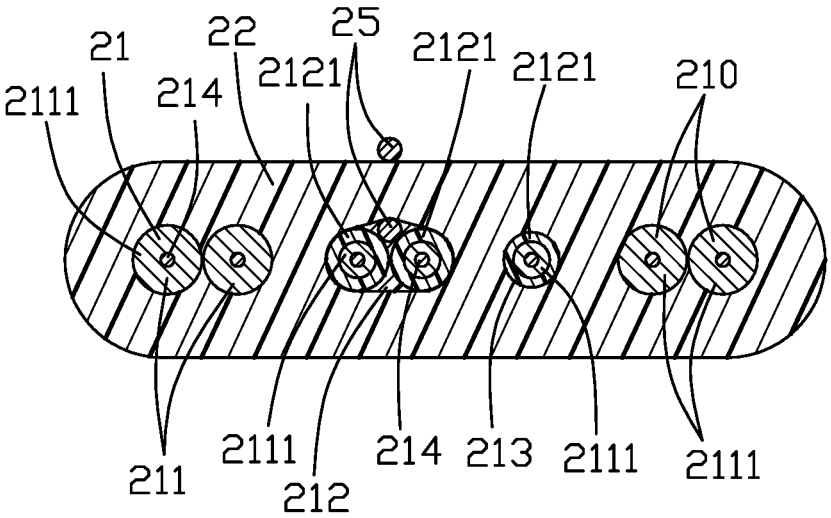
FIG. 8 is a cross-sectional view of a plug and a metal shell of the cable connector assembly taken along line 8-8 in FIG. 6.
Figure 9:
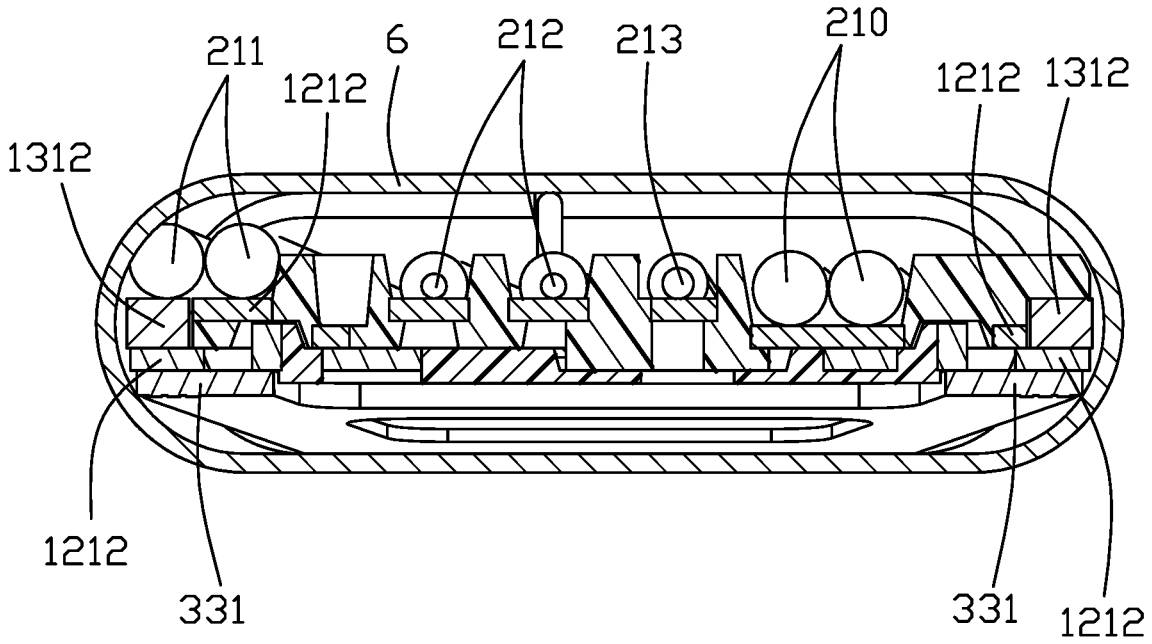
FIG. 9 is a cross-sectional view of the cable connector assembly taken along line 9-9 in FIG. 1.

Referring to FIGS. 1 to 9, a cable connector assembly 100 can be mated with the mating connector in two opposite directions and includes a plug 1, a cable 2 electrically connected with plug 1, a crimping member 3 crimped on the outside of the cable 2, and a metal shell 6 with receiving cavity 60 set on the outside of the plug 1 and cable 2. An inner mold (not shown) may be provided to enclose part of the plug 1 and the cable 2.

The plug 1 includes an insulative housing 11, a plurality of conductive terminals 12 received in the insulative housing 11, and a latch 13. The conductive terminals 12 include a row of first terminals 121 and a row of second terminals 122. The latch 13 is sandwiched between the first terminals 121 and the second terminals 122. The insulative housing 11 includes a first housing 111 fixing the first terminals 121, a second housing 112 fixing the second terminals 122 and a front housing 113 assembled at the front of first housing 111 and second housing 112. The insulative housing 11 has a positioning block for fixing a reinforcement 33 of the crimping member 3. The conductive terminals 12 include a plurality of ground terminals 1211. In this embodiment, both sides of the first terminals 121 and the second terminals 122 are ground terminals 1211. In other embodiments, The ground terminals 1211 may also be disposed at other positions in the conductive terminals 12. The rear end of the ground terminals 1211 has a welding portion 1212. The latch 13 includes two spaced latch arms 131 and a connecting arm 132 connecting two spaced latch arms 131. The front end of two spaced latch arms 131 both have latching portion 1311 locked with a mating connector. The rear ends of two spaced latch arms 131 both have fixing portion 1312.

The crimping member 3 includes a crimping ring 31 crimped on the outside of the cable 2, a reinforcement 33 fixed to a rear end region of the insulative housing 11 of the plug 1 and a connecting portion 32 connecting the crimping ring 31 and the reinforcement 33. In this embodiment, the crimping ring 31 covers the outside of the cable 2. The connecting portion 32 extends forward from one wall of the four walls of the crimping ring 31. The reinforcement 33 is formed to extend forward from left and right sides of the connecting portion 32, and includes two fixing pads 331 extending forward from left and right sides of the connecting portion 32, respectively. The fixing pads 331 have a positioning hole 3310. The positioning hole 3310 cooperates with the positioning block 116 to limit the position. In other embodiments, the specific structure of the crimping member 3 can be determined according to actual conditions.

In this embodiment, cable 2 is a flat cable and includes a plurality of cores 21 and an outer layer 22 coated on the outer side of the cores 21. The core 21 may be a first core or a second core. Each core includes a conductor 2111. Conductor of the first core is a bare conductor. Each second core includes an insulative layer 2121 coated on the conductor 2111. In this embodiment, the cores 21 include a pair of adjacently disposed power wires 210, a pair of adjacently disposed grounding wires 211, and a signal wire 212 and a detection wire 213 disposed between the power wires 210 and the grounding wires 211. Two power wires 210 are adjacent to each other and transmit the same power signal. Two grounding wires 211 are also adjacent to each other and commonly transmit the same ground signal. The signal wires 212 have a grounding wire 25, and the grounding wire 25 is folded over and attached to the outer side of the cable 2. The pair of grounding wires 211 and the pair of power wires 210 are first cores, and the signal wires 212 and detection wire 213 are second cores. In this embodiment, each conductor 2111 may include a wire 214 to improve the bending performance of the cable 2. In the present embodiment, by setting the first cores to be bare conductors, the thickness of the cable is minimized while ensuring the thickness of the outer layer. In this embodiment, all the conductors 2111 employ an ultra-fine, copper alloy structure to reinforce the bending performance of the cable 2 itself. In other embodiments, the cable 2 may also be a round wire, and the internal structure of the cable 2 may also be set according to actual conditions.

During assembly, the conductive terminals 12 are accommodated in the insulative housing 11, and the latch 13 is sandwiched between the first terminals 121 and the second terminals 122. In this embodiment, the two fixing portions 1312 of the latch 13 are respectively welded to the corresponding one or two welding portions 1212 of the grounding terminal 1211 to achieve grounding. The grounding wire 25 of the cable 2 is folded and overlaid on the outside of the cable 2, the cable 2 is electrically connected to the rear end of the conductive terminals 12, and the crimping ring 31 is riveted on the outside of the cable 2. The grounding wire 25 is press-fitted therein to achieve electrical contact between the crimping ring 31 and grounding wire 25. The positioning hole 3310 of the fixing pads 331 of the reinforcement 33 is limited to the positioning block 116 of the insulative housing 11, and then the fixing pads 331 is welded and fixed to the welding portion 1212 of the grounding terminals 1211. In other embodiments, the reinforcement 33 may be directly welded and fixed with the fixing portion 1312 of the locking member 13, or fixed and electrically connected through other fixing methods. In another embodiment, the fixing pads 331 of the reinforcement 33, the welding portion 1212 of the grounding terminals 1211, and the fixing portion 1312 of the latch 13 can be directly laser welded or other methods, and the three are simultaneously fixed and electrically connected together. Then, the inner mold is over-molded and mated with the cable 2 and the plug 1. Finally, the metal shell 6 is assembled from the rear thereof on the outside of the front end of the plug 1 and the cable 2. The front section of the metal shell 6 is glued to the inner mold by glue. The rear end of the metal shell 6 is pressed against the upper and lower walls 311 of the crimping ring 31 so that the crimping member 3 is grounded, so that the noise in the signal wire 212 is introduced into the ground through the metal shell 6. In a specific implementation process, a plastic member 7 may be added between the metal shell 6 and the crimping ring 31 so that the metal shell 6 is in close contact with the crimping ring 31 to avoid gaps between the two metal parts, resulting in easy loosening of the structure. In the present invention, by adding the reinforcement 33 fixed to the plug 1 in the crimping member 3. On the one hand, the overall structure of the cable connector assembly 100 of the present invention is made stronger, and avoids the phenomenon of breakage in the place where cable 2 and plug 1 are connected, and strengthens the tensile strength of the entire cable connector assembly 100; on the other hand, because the reinforcement 33 is in direct or indirect contact with the ground terminals 1211 to achieve electrical connection therebetween, the reinforcement 33 is grounded through the ground terminal 1211 so that even if the crimping ring 31 and the metal shell 6 resist poorly, when the crimping member 3 cannot be grounded through the crimping ring 31, the crimping member 3 can still be grounded through the reinforcement 33 to reduce signal interference.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable connector assembly comprising:

a plug including an insulative housing, a plurality of conductive terminals received in the insulative housing and a latch, the conductive terminals including a row of first terminals and a row of second terminals, the latch being disposed between the row of first terminals and the row of second terminals;

a cable directly electrically connected to the conductive terminals of the plug;

a crimping member; and a metal shell assembled on the plug, wherein the crimping member includes a crimping ring crimped on an outside of the cable, a reinforcement fixed to a rear end region of the insulative housing of the plug, and a connecting portion connecting the crimping ring and the reinforcement.

2. The cable connector assembly as claimed in claim 1, wherein the conductive terminals include a plurality of grounding terminals, and the reinforcement is electrically connected with the grounding terminals.

3. The cable connector assembly as claimed in claim 2, wherein the latch is electrically connected with the grounding terminals.

4. The cable connector assembly as claimed in claim 2, wherein the reinforcement includes two fixing pads respectively extending forward from left and right sides of the connecting portion, the grounding terminals include a welding portion, and the two fixing pads are welded and fixed to corresponding welding portion.

5. The cable connector assembly as claimed in claim 1, wherein the metal shell is in contact with the crimping ring.

6. The cable connector assembly as claimed in claim 1, wherein the cable includes a grounding wire, and the grounding wire is outwardly folded to expose the cable and contact with the crimping ring.

7. The cable connector assembly as claimed in claim 1, wherein the cable includes a plurality of cores and an outer layer wrapping around the cores, each of the core wires includes a conductor.

8. The cable connector assembly as claimed in claim 1, wherein the cable includes a plurality of cores and an outer layer wrapping around the cores, the cores include a plurality of first and second cores, each of the first cores is a bare conductor, and each of the second cores includes a conductor and an insulative outer layer.

9. The cable connector assembly as claimed in claim 8, wherein the first cores include a grounding wire and a power wire, and the second core includes a signal line between the grounding wire and the power wire.

10. The cable connector assembly as claimed in claim 9, wherein each of the power wire and the grounding wire has two adjacent wires.

11. A cable connector assembly comprising:

a plug including an insulative housing, two rows of contacts disposed in the insulative housing, and a latch retained in the housing between the two rows of contacts and including two spaced latch arms on two lateral sides;

a cable including a plurality of wires connected to the corresponding contacts, respectively;

a metal shell assembled on the plug; and a crimping member including, at a rear end thereof, a crimping ring crimped on an outside of the cable, and at a front end thereof, a reinforcement fixed to a rear end region of the insulative housing of the plug; wherein a grounding terminal of the contacts is sandwiched between the latch and the reinforcement in a vertical direction in a welded manner.

* * * * *